US007325505B2

(12) United States Patent
Otobe et al.

(10) Patent No.: US 7,325,505 B2
(45) Date of Patent: Feb. 5, 2008

(54) OUTBOARD MOTOR STEERING CONTROL SYSTEM

(75) Inventors: Taiichi Otobe, Wako (JP); Hideaki Takada, Wako (JP); Shinsaku Nakayama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/335,149

(22) Filed: Jan. 19, 2006

(65) Prior Publication Data

US 2006/0166567 A1 Jul. 27, 2006

(30) Foreign Application Priority Data

Jan. 21, 2005 (JP) ..... 2005-014308

(51) Int. Cl.
*B63H 25/04* (2006.01)

(52) U.S. Cl. ..... 114/144 R; 440/1; 440/84

(58) Field of Classification Search ..... 114/144 R, 114/144 A; 440/1, 53, 61 S, 84; 701/21
See application file for complete search history.

(56) References Cited

U.S. PATENT DOCUMENTS 6,234,853 B1 * 5/2001 Lanyi et al. ..... 440/53
6,994,046 B2 * 2/2006 Kaji et al. ..... 114/144 R
7,121,908 B2 * 10/2006 Okuyama ..... 440/84
2005/0199167 A1 * 9/2005 Mizutani ..... 114/144 R
2005/0282447 A1 * 12/2005 Okuyama ..... 440/53

FOREIGN PATENT DOCUMENTS

JP 08-276896 10/1996

* cited by examiner

*Primary Examiner*—Lars A. Olson
(74) *Attorney, Agent, or Firm*—Carrier, Blackman & Associates, PC.; Joseph P. Carrier; William D. Blackman

(57) ABSTRACT

In an outboard motor steering control system having a plurality of outboard motors each adapted to be mounted on a stern of a boat by a shaft to be movable by an actuator relative to the boat and each having an internal combustion engine to power a propeller, a desired steering angle of each outboard motor is determined individually based on detected engine speed and rotation angle of a steering wheel, and the operation of the actuator is controlled based on the determined desired steering angle, thereby improving both straight course-holding performance and turning performance by regulating the relative angles between the outboard motors in response to the cruising conditions of the boat.

22 Claims, 16 Drawing Sheets

FIG. 6

[ 650rpm ]

| θ sw | −540 | −360 | −180 | −5 | 0 | 5 | 180 | 360 | 540 |
|---|---|---|---|---|---|---|---|---|---|
| θ dr | −30.0 | −20.0 | −10.0 | −0.3 | 0 | 0.3 | 10.0 | 20.0 | 30.0 |
| θ dl | −30.0 | −20.0 | −10.0 | −0.3 | 0 | 0.3 | 10.0 | 20.0 | 30.0 |
| θ dl− θ dr | 0 | 0 | 0 | 0 | 0 | 0 | 0 | 0 | 0 |

IN [° ]

FIG. 8

[ 4000rpm ]

| θ sw | −540 | −360 | −180 | −5 | 0 | 5 | 180 | 360 | 540 |
|---|---|---|---|---|---|---|---|---|---|
| θ dr | −29.2 | −19.1 | −8.9 | −0.5 | −0.4 | 0.5 | 9.7 | 19.9 | 30.0 |
| θ dl | −30.0 | −19.9 | −9.7 | −0.5 | 0.4 | 0.5 | 8.9 | 19.1 | 29.2 |
| θ dl− θ dr | −0.8 | −0.8 | −0.8 | 0 | 0.8 | 0 | −0.8 | −0.8 | −0.8 |

IN [° ]

FIG. 12

[ 6000rpm ]

| θ sw | −540 | −360 | −180 | −5 | 0 | 5 | 180 | 360 | 540 |
|---|---|---|---|---|---|---|---|---|---|
| θ dr | −29.0 | −18.9 | −8.7 | −0.6 | −0.5 | 0.6 | 9.7 | 19.9 | 30.0 |
| θ dl | −30.0 | −19.9 | −9.7 | −0.6 | 0.5 | 0.6 | 8.7 | 18.9 | 29.0 |
| θ dl− θ dr | −1.0 | −1.0 | −1.0 | 0 | 1.0 | 0 | −1.0 | −1.0 | −1.0 |

IN [° ]

FIG. 15

[ RAPID DECELERATION ]

| θ sw | −540 | −360 | −180 | −5 | 0 | 5 | 180 | 360 | 540 |
|---|---|---|---|---|---|---|---|---|---|
| θ dr | −28.0 | −17.9 | −7.7 | 0.2 | 0.5 | 1.3 | 9.7 | 19.9 | 30.0 |
| θ dl | −30.0 | −19.9 | −9.7 | −1.3 | −0.5 | −0.2 | 7.7 | 17.9 | 28.0 |
| θ dl− θ dr | −2.0 | −2.0 | −2.0 | −1.5 | −1.0 | −1.5 | −2.0 | −2.0 | −2.0 |

IN [° ]

FIG. 17

[ REVERSE ]

| θ sw | −540 | −360 | −180 | −5 | 0 | 5 | 180 | 360 | 540 |
|---|---|---|---|---|---|---|---|---|---|
| θ dr | −30.0 | −20.0 | −10.0 | −0.3 | 0 | 0.3 | 10.0 | 20.0 | 30.0 |
| θ dl | −30.0 | −20.0 | −10.0 | −0.3 | 0 | 0.3 | 10.0 | 20.0 | 30.0 |
| θ dl− θ dr | 0 | 0 | 0 | 0 | 0 | 0 | 0 | 0 | 0 |

IN [° ]

OUTBOARD MOTOR STEERING CONTROL SYSTEM

BACKGROUND OF THE INVENTION

1. Field of the Invention

This invention relates to an outboard motor steering control system, particularly to an outboard motor steering control system for steering multiple outboard motors.

2. Description of the Related Art

When two or more outboard motors are mounted on the stem of a hull (boat) in what is known as a multiple outboard motor installation, the outboard motors are usually connected by links called tie bars for enabling mechanically interconnected steering of the outboard motors, as disclosed in Japanese Laid-Open Patent Application No. Hei 8 (1996)-276896, for example.

In the case of multiple outboard motor installation, the straight course-holding performance or turning performance of boat can be improved by giving the outboard motors different steering angles in response to the cruising conditions so as to regulate their relative angles. To be more specific, straight course-holding performance can be improved by establishing the relative angles so that extensions of the propeller axes of rotation intersect forward of the outboard motors, thereby minimizing lateral deflection of the boat. Turning performance can be improved by making the extensions of the propeller axes of rotation intersect rearward of the outboard motors.

When multiple outboard motors are mechanically interconnected by tie bars as in the prior art, the relative angles between the outboard motors are solely or uniquely determined. This makes it impossible to regulate the relative angles between the outboard motors in response to the cruising conditions, so that improvement of both straight course-holding performance and turning performance cannot be achieved.

SUMMARY OF THE INVENTION

An object of this invention is therefore to overcome this problem by providing an outboard motor steering control system that improves both straight course-holding performance and turning performance by regulating the relative angles between multiple boat-mounted outboard motors in response to the cruising conditions.

In order to achieve the above object, this invention provides a system for controlling the steering of a plurality of outboard motors each adapted to be mounted on a stern of a boat by a shaft so as to be movable by an actuator relative to the boat and each having an internal combustion engine and a propeller powered by the engine to propel the boat, comprising: a crank angle sensor detecting a speed of at least one of the engines installed in the outboard motors; a rotation angle sensor detecting a rotation angle of a steering wheel installed at a cockpit of the boat; a desired steering angle determining mechanism for determining a desired steering angle of each outboard motor individually based on at least one of the detected engine speed and the detected rotation angle of the steering wheel; and a controller for controlling operation of the actuator based on the determined desired steering angle.

BRIEF DESCRIPTION OF THE DRAWINGS

The above and other objects and advantages of the invention will be more apparent from the following description and drawings in which:

FIG. 6 is a table showing some specific numerical values taken from the characteristics shown in FIG. 5;

FIG. 8 is a table showing some specific numerical values taken from the characteristics shown in FIG. 7;

FIG. 12 is a table showing some specific numerical values taken from the characteristics shown in FIG. 11;

FIG. 15 is a table showing some specific numerical values taken from the characteristics shown in FIG. 14;

FIG. 17 is a table showing some specific numerical values taken from the characteristics shown in FIG. 16.

DETAILED DESCRIPTION OF THE PREFERRED EMBODIMENT

An embodiment of an outboard motor steering control system according to the present invention will now be explained with reference to the attached drawings.

Figure 1:
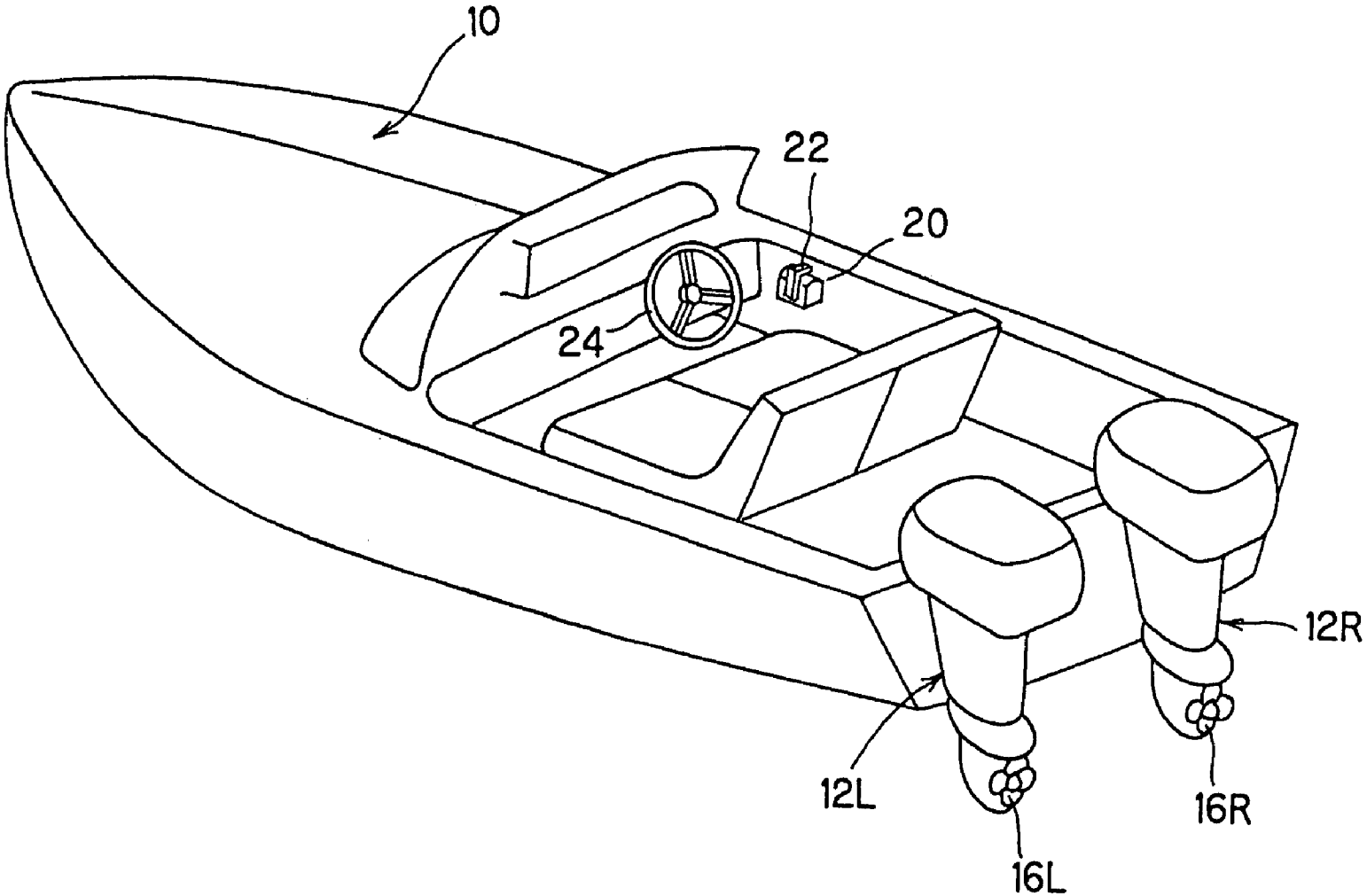
FIG. 1 is a schematic view showing a boat and outboard motors to which an outboard motor steering control system according to an embodiment of the invention is installed.
Figure 2:
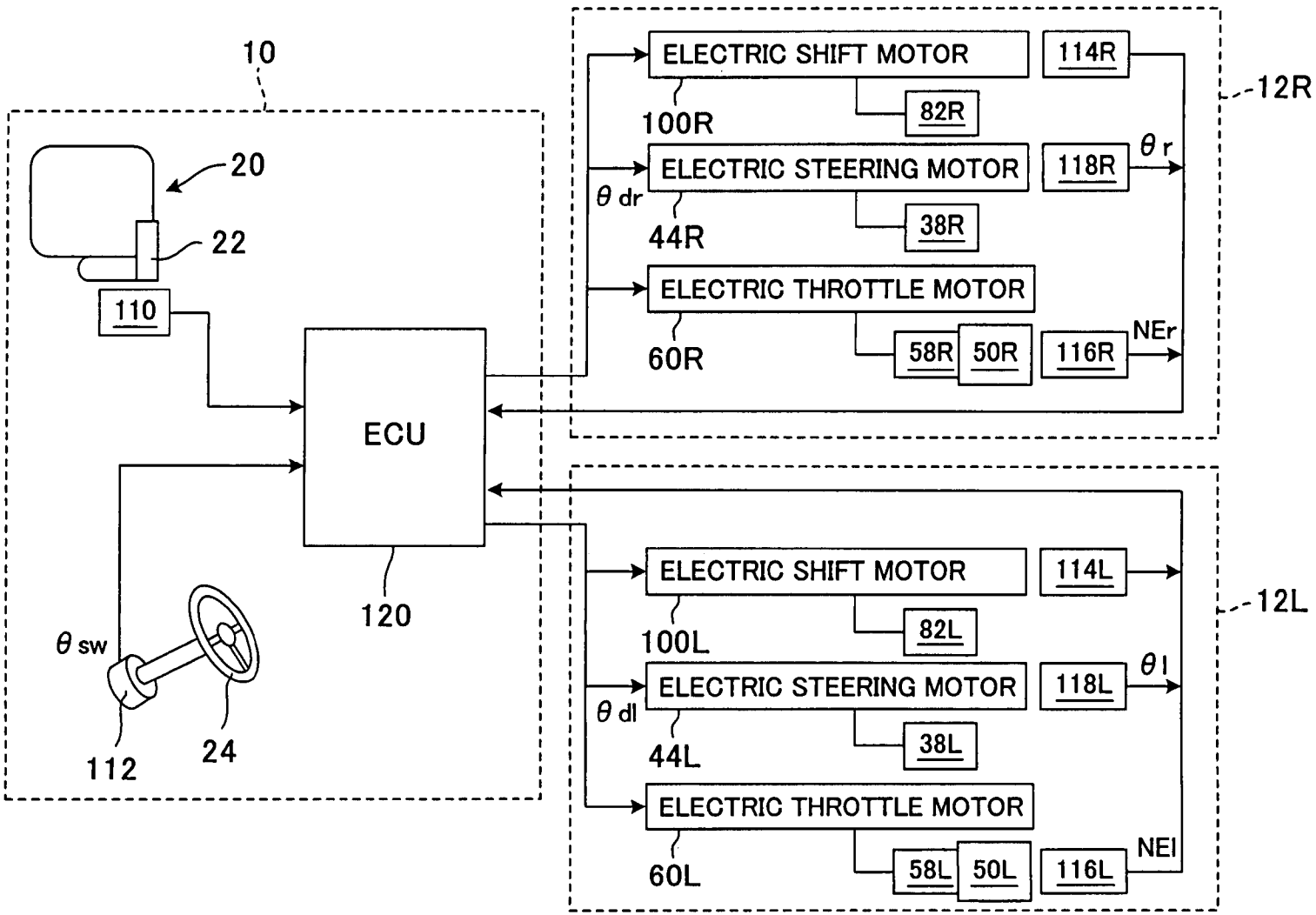
FIG. 2 is a block diagram of the outboard motor steering control system according to an embodiment of the present invention.

FIG. 1 is a schematic view showing a boat and outboard motors to which the outboard motor steering control system according to the present exemplary embodiment of the invention is installed, and FIG. 2 is a block diagram of the outboard motor steering control system.

As shown in FIG. 1, a plurality of (two) outboard motors are mounted on the stem of a boat (hull) 10. In other words, the boat 10 has what is known as a multiple (dual) outboard motor installation. In the following, the starboard side outboard motor, i.e., outboard motor on the right side when looking in the direction of forward travel is called the "starboard outboard motor" and assigned the reference symbol 12R. The port side outboard motor, i.e., outboard motor on the left side when looking in the direction of forward travel is called the "port outboard motor" and assigned the reference symbol 12L.

The starboard and port outboard motors 12R, 12L are equipped with propellers 16R, 16L. The propellers 16R, 16L are rotated by power transmitted from engines and produce thrust for propelling the boat 10.

A remote control box 20 is installed near a cockpit of the boat 10. The remote control box 20 is equipped with a lever 22 to be manipulated by the operator. The lever 22 can be rotated fore and aft (toward and away from the operator) from its initial position, by which the operator can input shift (gear) position commands and engine speed regulation commands. A steering wheel 24 is also installed near the cockpit to be rotatably manipulated. The operator can rotate the steering wheel 24 to input steering or turning commands.

Figure 3:
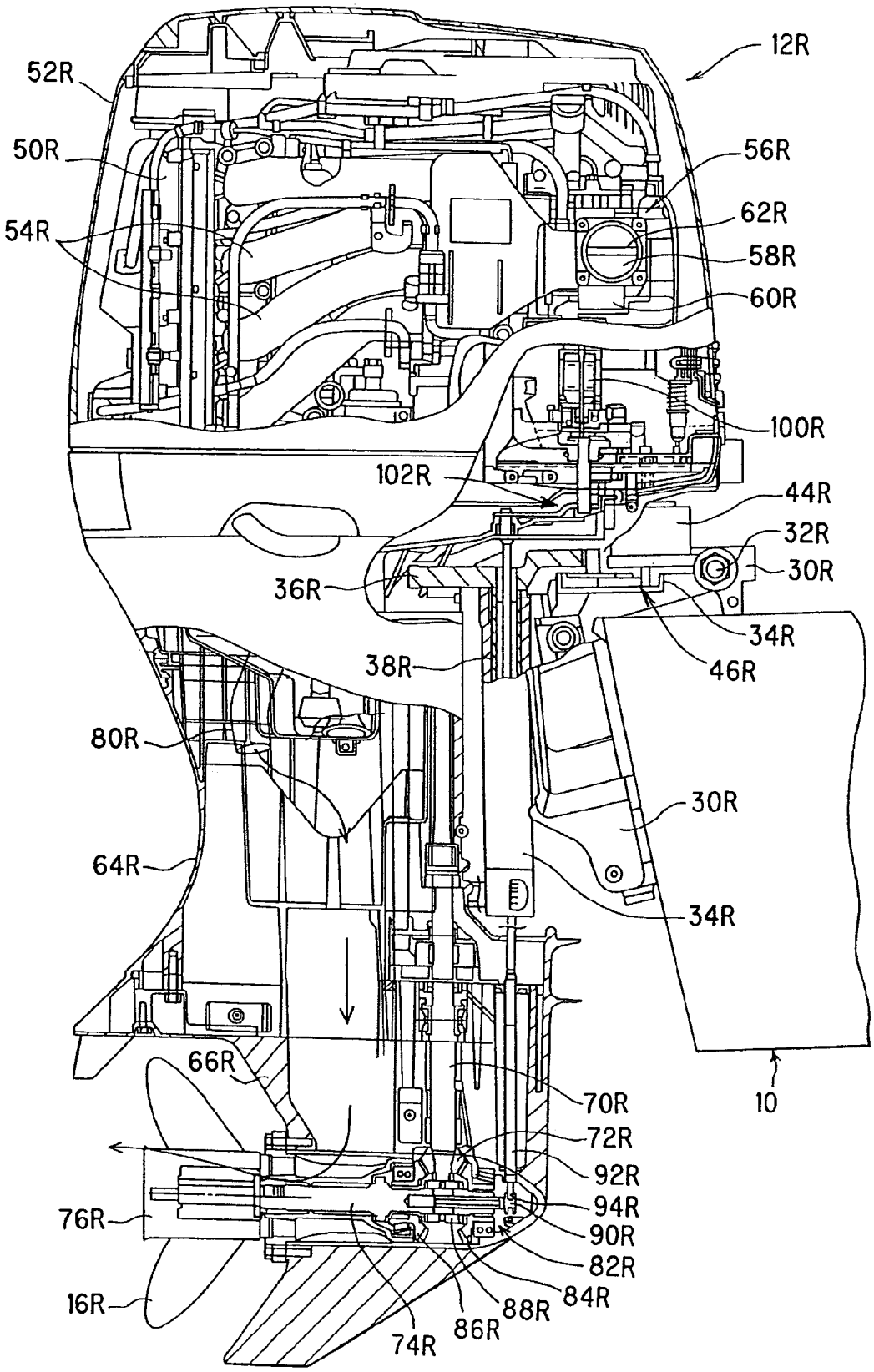
FIG. 3 is an enlarged sectional side view showing the region of a starboard outboard motor shown in FIG. 1.

FIG. 3 is an enlarged sectional side view showing the region of the starboard outboard motor 12R shown in FIG. 1. The starboard outboard motor 12R will be explained with reference to FIG. 3.

As shown in FIG. 3, the starboard outboard motor 12R is equipped with stern brackets 30R fastened to the stern of the boat 10. A swivel case 34R is attached to the stern brackets 30R through a tilting shaft 32R.

A mount frame 36R installed in the starboard outboard motor 12R is equipped with a shaft (swivel shaft) 38R. The shaft 38R is housed in the swivel case 34R to be freely rotated about a vertical axis. The upper end of mount frame 36R and lower end thereof (i.e., lower end of the shaft 38R) are fastened to a frame (not shown) constituting a main body of the starboard outboard motor 12R.

The upper portion of the swivel case 34R is installed with an electric steering motor (steering actuator) 44R that drives the mount frame 36R. The output shaft of the steering motor 44R is connected to the upper end of mount frame 36R via a speed reduction gear mechanism 46R. Specifically, a rotational output generated by driving the steering motor 44R is transmitted via the speed reduction gear mechanism 46R to the mount frame 36R such that the starboard outboard motor 12R is steered about the shaft 38R as a rotational axis to the right and left directions (i.e., steered about the vertical axis).

The starboard outboard motor 12R is equipped with an engine 50R at its upper portion. The engine 50R comprises a spark-ignition gasoline engine with a displacement of 2,200 cc. The engine 50R is located above the water surface and covered by an engine cover 52R.

The engine 50R has an intake pipe 54R that is connected to a throttle body 56R. The throttle body 56R has a throttle valve 58R installed therein and an electric throttle motor (throttle actuator) 60R is integrally disposed thereto to drive the throttle valve 58R. The output shaft of the throttle motor 60R is connected via a speed reduction gear mechanism (not shown) installed near the throttle body 56R with a throttle shaft 62R that rotatably supports the throttle valve 58R. Specifically, a rotational output generated by driving the throttle motor 60R is transmitted to the throttle shaft 62R to open and close the throttle valve 58R, thereby regulating air sucked in the engine 50R to control the engine speed.

An extension case 64R is installed at the lower portion of the engine cover 52R and a gear case 66R is installed at the lower portion of the extension case 64R. A drive shaft (vertical shaft) 70R is supported in the extension case 64R and gear case 66R to be freely rotated about the vertical axis. One end, i.e., the upper end of the drive shaft 70R is connected to a crankshaft (not shown) of the engine 50R and the other end, i.e., the lower end thereof is equipped with a pinion gear 72R.

A propeller shaft 74R is supported in the gear case 66R to be freely rotated about the horizontal axis. One end of the propeller shaft 74R extends from the gear case 66R toward the rear of the starboard outboard motor 12R and the propeller 16R is attached thereto, i.e., the one end of the propeller shaft 74R, via a boss portion 76R.

As indicated by the arrows in FIG. 3, the exhaust gas (combusted gas) emitted from the engine 50R is discharged from an exhaust pipe 80R into the extension case 64R. The exhaust gas discharged into the extension case 64R further passes through the interior of the gear case 66R and the interior of the boss portion 76R to be discharged into the water to the rear of the propeller 16R.

A shift mechanism 82R is also housed in the gear case 66R. The shift mechanism 82R comprises a forward bevel gear 84R, a reverse bevel gear 86R, a shift clutch 88R, a shift slider 90R and a shift rod 92R. The forward bevel gear 84R and reverse bevel gear 86R are disposed onto the outer periphery of the propeller shaft 76R to be rotatable in opposite directions by engagement with the pinion gear 72R. The shift clutch 88R is installed between the forward bevel gear 84R and reverse bevel gear 86R and is rotated integrally with the propeller shaft 76R.

The shift rod 92R penetrates in the starboard outboard motor 12R. Specifically, the shift rod 92R is supported to be freely rotated about the vertical axis in a space from the engine cover 52R, passing through the swivel case 34R (more specifically the interior of the swivel shaft 38R accommodated therein), to the gear case 66R. The shift clutch 88R is connected via the shift slider 90R to a rod pin 94R disposed on the bottom of the shift rod 92R. The rod pin 94R is formed at a location offset from the center of the bottom of the shift rod 92R by a predetermined distance. As a result, rotation of the shift rod 92R causes the rod pin 94R to move while describing an arcuate locus whose radius is the predetermined distance (offset amount).

The movement of the rod pin 94R is transferred through the shift slider 90R to the shift clutch 88R as displacement parallel to the axial direction of the propeller shaft 74R. As a result, the shift clutch 88R is slid to a position where it engages one or the other of the forward bevel gear 84R and reverse bevel gear 86R or to a position where it engages neither of them.

When the shift clutch 88R is engaged with the forward bevel gear 84R (the forward shift (gear) position command is inputted), the rotation of the drive shaft 70R is transmitted through the pinion gear 72R, forward bevel gear 84R and shift clutch 88R to the propeller shaft 74R, thereby rotating the propeller 16R to produce thrust in the direction of propelling the boat 10 forward. Thus the forward shift (gear) position is established. On the other hand, when the shift clutch 88R is engaged with the reverse bevel gear 86R (the reverse shift (gear) position command is inputted), the rotation of the drive shaft 70R is transmitted through the pinion gear 72R, reverse bevel gear 86R and shift clutch 88R to the propeller shaft 74R, thereby rotating the propeller 16R in the direction opposite from that during forward travel to produce thrust in the direction of propelling the boat 10 rearward. Thus the reverse shift (gear) position is established.

When the shift clutch 88R is not engaged with either the forward bevel gear 84R or the reverse bevel gear 86R, the rotation of the drive shaft 70R is not transmitted to the propeller shaft 74R and the rotation of the propeller 16R is stopped. Thus the neutral shift (gear) position is established.

The interior of the engine cover 52R is disposed with an electric shift motor (shift actuator) 100R that drives the shift mechanism 82R to change the gear position. The output shaft of the shift motor 100R is connected to the upper end of the shift rod 92R through a speed reduction gear mechanism 102R. Therefore, when the shift motor 100R is driven, its rotational output is transmitted to the shift rod 92R through the speed reduction gear mechanism 102R, thereby rotating the shift rod 92R about the vertical axis. The rotation of the shift rod 92R drives (slides) the shift clutch 88R to conduct the shift (gear) change.

It should be noted that, since the configurations of the starboard outboard motor 12R and port outboard motor 12L are the same, the explanation made with reference to FIG. 3 is also applied to the port outboard motor 12L. When indicating a member of the port outboard motor 12L in the following explanation, "L" will be assigned instead of "R" that is appended to the reference numerals of the members already explained with FIG. 3.

Based on the foregoing explanation, the block diagram of FIG. 2 will now be explained.

As shown in FIG. 2, a lever position sensor 110 is provided near the lever 22 of the remote control box 20 installed on the boat 10. The lever position sensor 110 produces an output or signal corresponding to the position to which the lever 22 is manipulated by the operator. A rotation angle sensor 112 is provided on the rotating shaft of the steering wheel 24. The rotation angle sensor 112 produces an output or signal proportional to the rotation angle θsw of the steering wheel 24 manipulated by the operator.

Shift position sensors 114R, 114L are installed near the shift motors 100R, 100L of the outboard motors. The shift position sensors 114R, 114L produce outputs or signals in response to the output rotation angle, i.e., shift (gear) position, of the shift motors 100R, 100L. Crank angle sensors 116R, 116L are installed near the crankshafts (not shown) of the engines 50R, 50L mounted on the outboard motors. The crank angle sensors 116R, 116L output the pulse signals at every predetermined crank angle (e.g., 30 degrees). Further, steering angle sensors 118R, 118L are provided near the shafts 38R, 38L that are the steering shafts of the outboard motors. The steering angle sensors 118R, 118L produce outputs or signals in response to the steering angle θr of the starboard outboard motor and steering angle θl of the port outboard motor.

The outputs of the foregoing sensors are inputted to an electronic control unit (ECU) 120. The ECU 120 comprising a microcomputer equipped with an input/output circuit, CPU and the other components (none of which shown) is disposed at an appropriate position in the boat 10.

The ECU 120 controls the operation of the shift motors 100R, 100L of the outboard motors and operates the shift mechanisms 82R, 82L to change a shift (gear) position based on the output of the lever position sensor 110 (more exactly, the manipulated direction of the lever 22 determined from the output value). The ECU 120 also determines whether the shift change has been completed or finished based on the outputs of the shift position sensors 114R, 114L and, when the completion is determined, terminates the operation of the shift motors 100R, 100L. It also controls the operation of the throttle motors 60R, 60L based on the output of the lever position sensor 110 (more exactly, the magnitude of the output value) to regulate the engine speed.

The ECU 120 counts the output signals of the crank angle sensors 116R, 116L to calculate or detect speed NEr, NEl of the engines 50R, 50L. Furthermore, the ECU 120 determines desired steering angles θdr, θdl of the outboard motors 12R, 12L respectively based on the engine speed NEr, NEl, the rotation angle θsw of the steering wheel 24 and the outputs of the shift position sensors 114R, 114L, and controls the operation of the steering motors 44R, 44L to steer the outboard motors 12R, 12L individually on the basis of the determined desired steering angles θdr, θdl (specifically, such that the detected steering angles θdr, θdl become desired steering angles θdr, θdl).

It should be noted that the total rotation angle of the steering wheel 24 is 1080 degrees in this present exemplary embodiment. Specifically, the lock-to-lock of the steering wheel 24 is set to be 3 revolutions and the steering wheel 24 can be freely rotated by 540 degrees to each of right and left directions. The total steering angle of each outboard motor 12K, 12L is set to be 60 degrees. Specifically, the outboard motors 12K, 12L are freely steered by 30 degrees to each of right and left directions from the neutral position.

The control of the operation of the steering motors 44R, 44L will now be explained with focus on the determination of the desired steering angles θdr, θdl.

Figure 4:
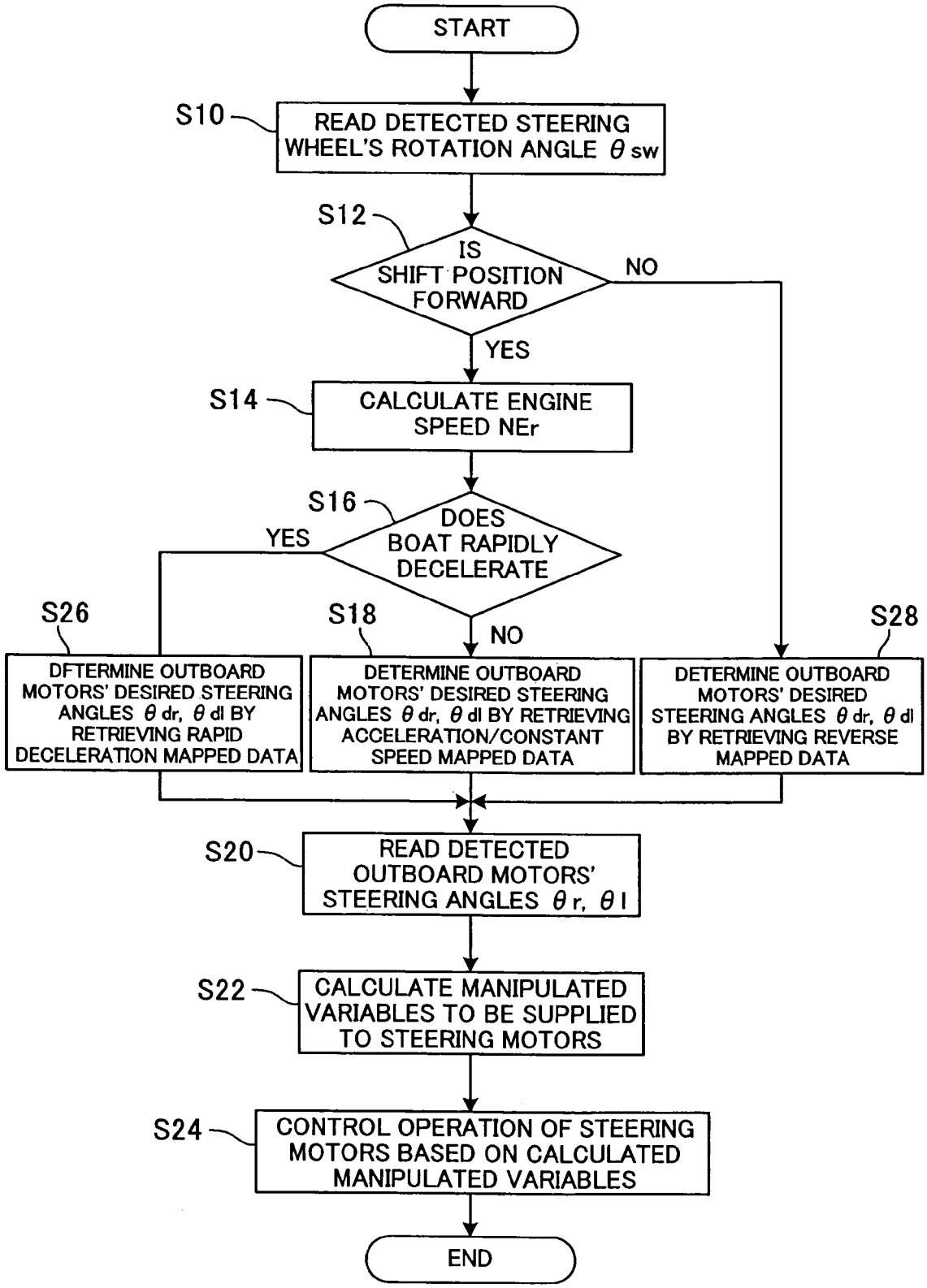
FIG. 4 is a flowchart showing the flow of processing for controlling steering motors shown in FIG. 2.

FIG. 4 is a flowchart showing the flow of processing for controlling the steering motors 44R, 44L. The ECU 120 executes this routine at predetermined intervals (e.g., every 10 milliseconds).

First, in S10, the rotation angle θsw of the steering wheel 24 detected by the rotation angle sensor 112 is read. Next, in S12, it is determined whether the shift (gear) position is forward. The determination in S12 is made by referring to the outputs of the shift position sensors 114R, 114L or the output of the lever position sensor 110.

When the result in S12 is YES, the program goes to S14, in which the engine speed NEr of the starboard outboard motor 12R is calculated or detected. Next, in S16, it is determined whether or not the boat 10 is rapidly decelerating based on the amount of change in the speed of the boat 10. In this present exemplary embodiment, the amount of boat speed change is determined from the amount of change in the engine speed NEr per unit time. Specifically, the engine speed NEr one second earlier is subtracted from the current engine speed NEr and the boat 10 is determined to be rapidly decelerating if the difference is −2,000 or more. In other words, a per-second decrease of 2,000 rpm or more in the engine speed NEr is determined as "rapid deceleration."

When the result in S16 is NO, i.e., when the boat 10 is found to be accelerating or cruising at a constant speed (defined to include gradual deceleration), the program goes to S18, in which the desired steering angles θdr, θdl of the starboard and port outboard motors 12R, 12L are determined individually based on the rotation angle θsw of the steering wheel and engine speed NEr.

Mapped data representing the relationship between the desired steering angles θdr, θdl and the rotation angle θsw are stored in a RAM (not shown) of the ECU 120. The mapped data are divided into a number of acceleration/constant speed mapped data, rapid deceleration mapped data, and reverse mapped data. Separate acceleration/constant speed mapped data are created for every engine speed NEr. In S18, mapped data are selected from among the acceleration/constant speed mapped data based on the engine speed NEr, and the desired steering angles θdr, θdl corresponding to the rotation angle θsw are then retrieved from the selected mapped data.

Figure 5:
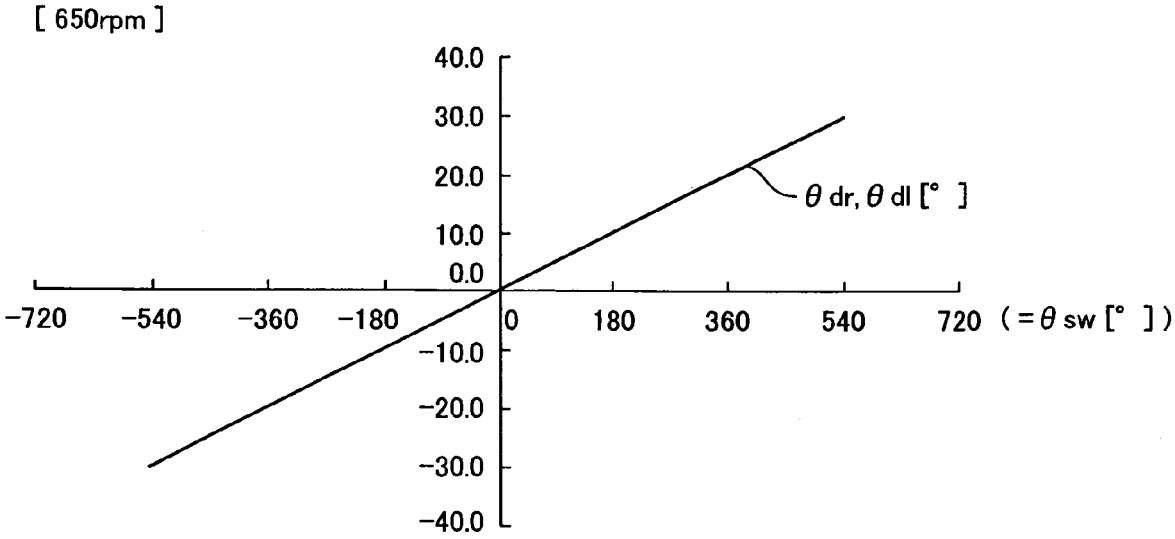
FIG. 5 is a graph representing the characteristics of desired steering angles with respect to rotation angle of a steering wheel shown in FIG. 2 when the engine speed is 650 rpm.

FIG. 5 is a graph representing the characteristics of the acceleration/constant speed mapped data to be used when the engine speed NEr is 650 rpm (idling speed). FIG. 6 is a table showing some specific numerical values in degrees taken from the characteristics shown in FIG. 5 (characteristics of the desired steering angles θdr, θdl against the rotation angle θsw). In this present exemplary embodiment, the steering direction when the outboard motors 12R, 12L are rotated clockwise as viewed from above (when the propellers 16R, 16L move from right to left as viewed from behind) is defined as positive. The direction of rotation of the steering wheel 24 when the outboard motors 12R, 12L are rotated clockwise is defined as positive.

As shown in FIGS. 5 and 6, when the engine speed NEr is idling speed, the desired steering angle θdr of the starboard outboard motor and the desired steering angle θdl of the port outboard motor are set or determined to the same value (i.e., the difference between θdr and θdl is made 0). The axis of rotation of the propeller 16R, i.e., the propeller shaft 74R of the starboard outboard motor and the axis of rotation of the propeller 16L, i.e., the propeller shaft 74L of the port outboard motor are therefore maintained parallel irrespective of the rotation angle θsw of the steering wheel. This is because when the boat is moving at a very low speed good straight course-holding performance and turning performance can be maintained without particularly taking the relative angle between the outboard motors into account.

Figure 7:
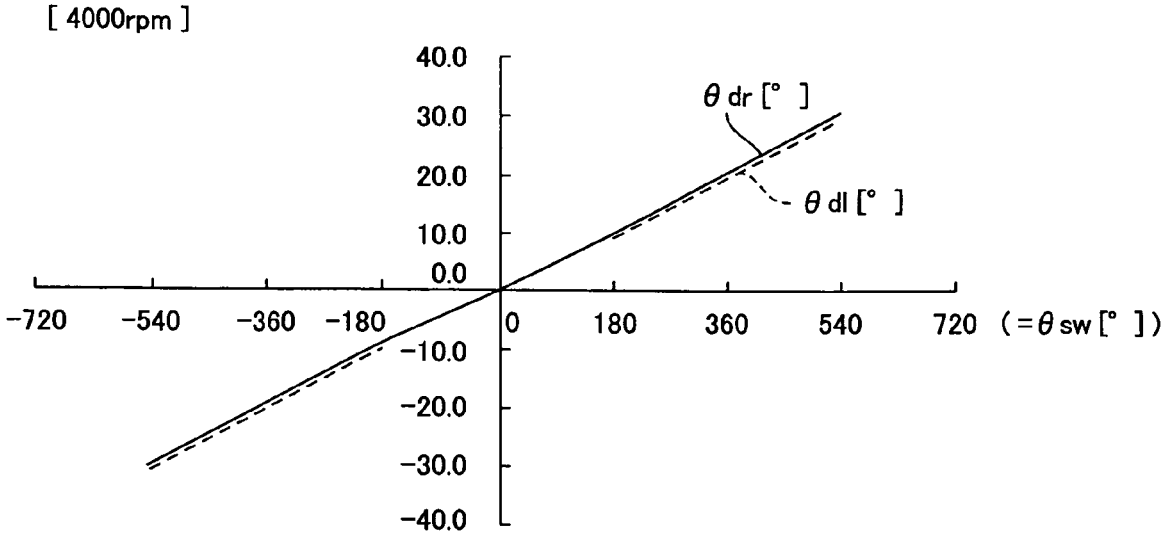
FIG. 7 is a graph representing the characteristics of desired steering angles with respect to rotation angle of the steering wheel shown in FIG. 2 when the engine speed is at 4000 rpm.

FIG. 7 is a graph, similar to that of FIG. 5, but representing the characteristics of the acceleration/constant speed mapped data to be used when the engine speed NEr is 4,000 rpm. FIG. 8 is a table similar to that of FIG. 6 showing some specific numerical values taken from the characteristics shown in FIG. 7.

As shown in FIGS. 7 and 8, when the engine speed NEr increases, the desired steering angle θdr and desired steering angle θdl are assigned different values to establish a difference between the two. When the steering wheel rotation angle θsw is 0 degree (when the operator wants to go straight ahead), θdr and θdl are assigned the same absolute value but made opposite in sign. Specifically, θdr is made −0.4 degree and θdl is made 0.4 degree. The difference between them (value obtained by subtracting θdr from θdl; hereinafter designated difference Δθd) is thus made 0.8 degree.

Figure 9:
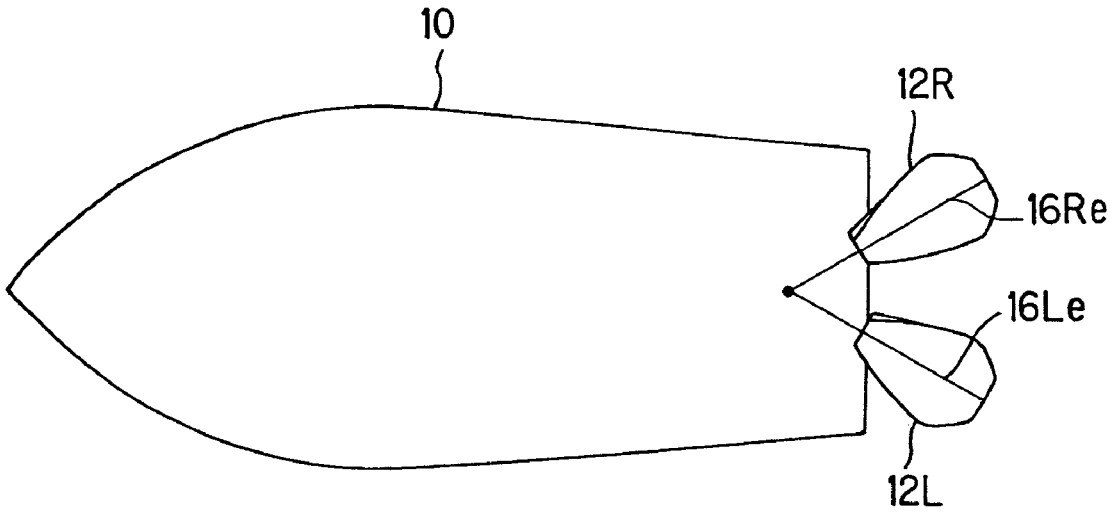
FIG. 9 is an explanatory view showing the relative angle between the starboard outboard motor and a port outboard motor shown in FIG. 2.

FIG. 9 is an explanatory graph showing the relative angle between the starboard outboard motor 12R and port outboard motor 12L.

As shown, the setting of θdr to −0.4 degree steers the starboard outboard motor 12R counterclockwise (in the direction of moving its propeller left to right as viewed from behind). The setting of θdl to 0.4 degree steers the port outboard motor 12L clockwise (in the direction of moving its propeller right to left as viewed from behind). As a result, the extension of the axis of rotation of the starboard outboard motor propeller (designated 16Re) and the extension of the axis of rotation of the port outboard motor propeller (designated 16Le) are made to intersect forward of the outboard motors 12R, 12L. This condition is referred to as "toe-in" and the difference Δθd at this time is referred to as the "toe-in angle." The toe-in angle is exaggerated in FIG. 9 to make it easy to recognize.

The explanation of FIGS. 7 and 8 will be continued. The absolute value of the desired steering angles θdr, θdl increases with increasing absolute value of the steering wheel rotation angle θsw. However, within the range of absolute values of the rotation angle θsw under 5 degrees, the difference Δθd is kept constantly at the same value as when the rotation angle θsw is 0 degree, i.e., at 0.8 degree. In other words, toe-in is maintained so long as the boat 10 is moving straight ahead or nearly straight ahead. The resulting suppression of boat lateral deflection improves the straight course-holding performance of the boat 10.

When the absolute value of the rotation angle θsw is in the range of 5 degrees to less than 180 degrees, i.e., when the boat 10 is turning, the difference Δθd is made 0 degree. In other words, θdr and θdl are assigned the same value. This does away with the toe-in, thereby improving the turning performance of the boat 10.

Figure 10:
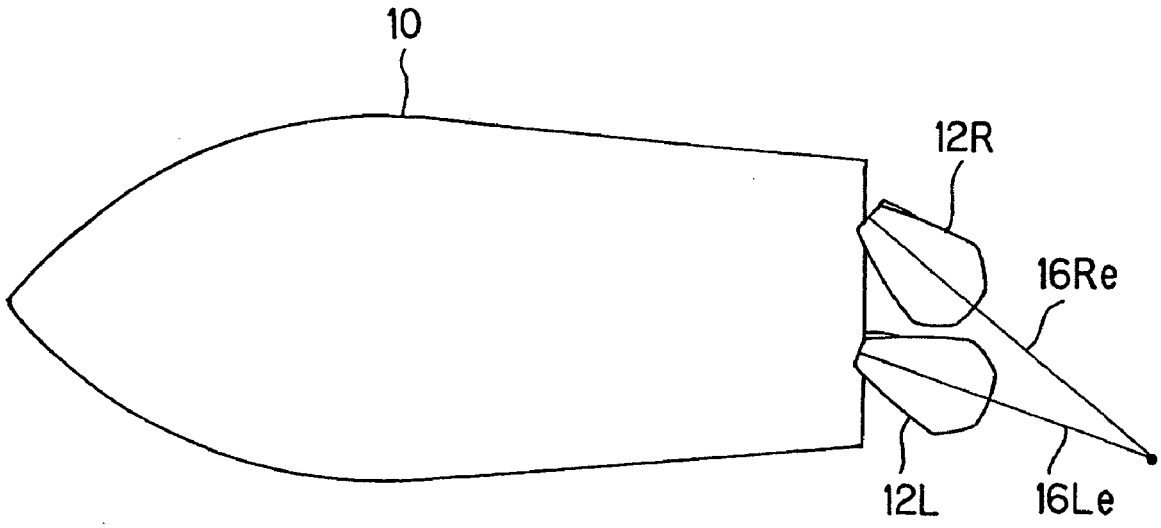
FIG. 10 is an explanatory view similar to FIG. 9 showing the relative angle between the starboard outboard motor and port outboard motor shown in FIG. 2.

When the absolute value of the steering wheel rotation angle θsw reaches 180 degrees, the difference Δθd is made −0.8. As shown in FIG. 8, during clockwise steering of the outboard motors 12R, 12L (when the desired steering angles θdr, θdl are positive values), the desired steering angle θdr of the starboard outboard motor is made larger than that of port outboard motor, and during counterclockwise steering (when the desired steering angles θdr, θdl are negative values), the desired steering angle θdl of the port outboard motor is made larger (in absolute value) than that of starboard outboard motor. In other words, as shown in FIG. 10, the desired steering angle of the outboard motor on the opposite side from the turning direction of the boat 10 (the outside outboard motor) is made larger. As a result, the extension 16Re of the axis of rotation of the starboard outboard motor propeller and the extension 16Le of the axis of rotation of the port outboard motor propeller are made to intersect rearward of the outboard motors 12R, 12L. This condition is referred to a "toe-out" and the difference Δθd at this time is referred to as the "toe-out angle." The toe-out angle is exaggerated in FIG. 9 to make it easy to recognize.

As shown in FIGS. 7 and 8, the difference Δθd is kept constantly at −0.8 degree when the absolute value of the rotation angle θsw is 180 degrees or greater. In other words, toe-out is maintained during relatively sharp turning at a steering wheel rotation angle θsw of 180 degrees or greater, thereby improving the turning performance.

Figure 11:
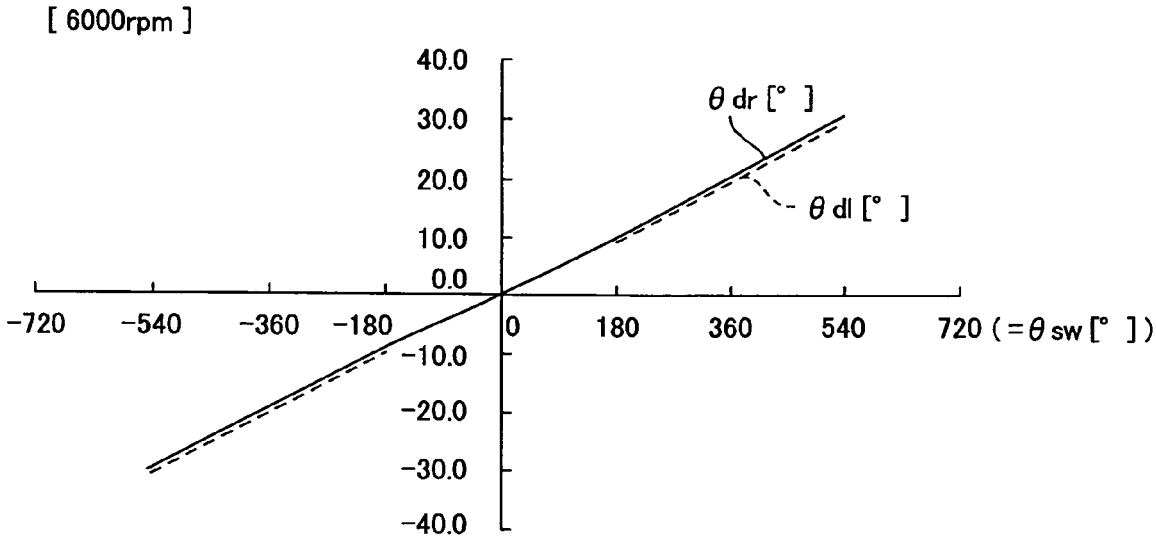
FIG. 11 is a graph representing the characteristics of desired steering angles with respect to rotation angle of the steering wheel shown in FIG. 2 when the engine speed is 6000 rpm.

FIG. 11 is a graph similar to that of FIG. 5, but representing the characteristics of the acceleration/constant speed mapped data to be used when the engine speed NEr is 6,000 rpm. FIG. 12 is a table similar to that of FIG. 6 showing some specific numerical values taken from the characteristics shown in FIG. 11.

As shown in FIGS. 11 and 12, when the engine speed NEr increases further (when the boat speed increases), the difference Δθd is increased in absolute value. Specifically, the difference Δθd is made 1.0 degree when the absolute value of the steering wheel rotation angle θsw is in the range of 0 degree to less than 5 degrees and is made −1.0 when the absolute value of the rotation angle θsw is 180 degrees or greater. This increases the toe-in angle when the boat is moving straight ahead and the toe-out angle when the boat is turning sharply, thereby ensuring good straight course-holding performance and turning performance during high-speed cruising.

Thus the difference Δθd between the desired steering angles θdr and θdl of the outboard motors is regulated taking into account the steering wheel rotation angle θsw and engine speed NEr. Although examples of the difference Δθd are cited for engine speeds NEr of 650 rpm, 4,000 rpm and 6,000 rpm in the foregoing, the difference Δθd is actually varied continuously with the engine speed NEr.

Figure 13:
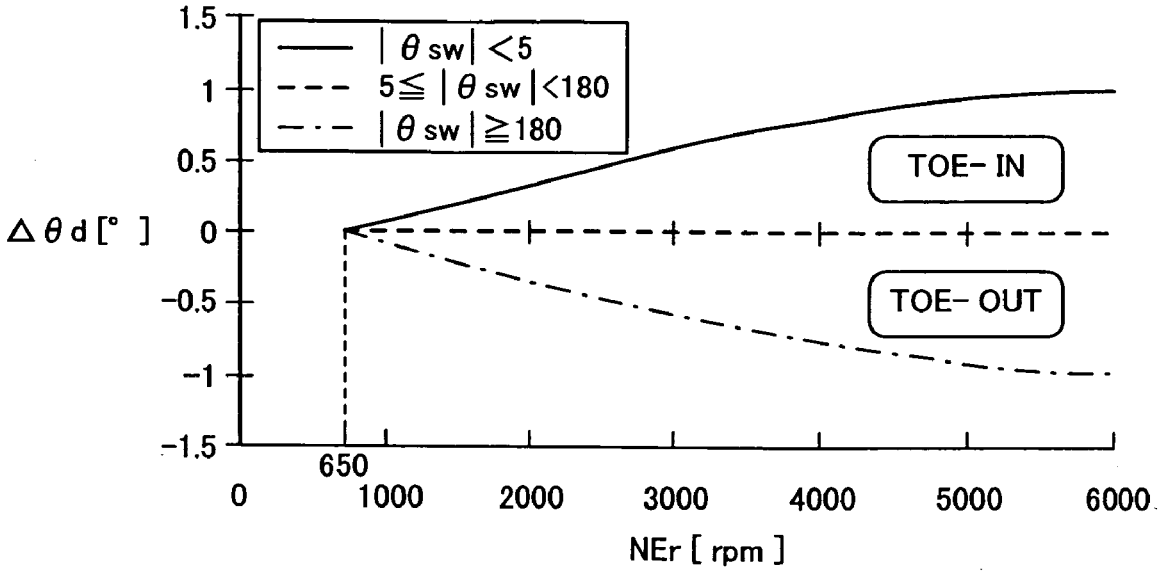
FIG. 13 is a graph showing the characteristics of a difference between the desired steering angles with respect to engine speed of the outboard motors shown in FIG. 2.

FIG. 13 shows how the difference Δθd varies as a function of the engine speed NEr. As shown, the absolute value of the difference Δθd (i.e., the toe-in angle and toe-out angle) increases continuously with engine speed NEr.

The explanation of the flowchart of FIG. 4 will be resumed.

Next, in S20, the steering angle θr of the starboard outboard motor 12R and steering angle θl of the port outboard motor 12L detected by the steering angle sensors 118R, 118L are read. Next, in S22, the manipulated variables or control inputs to be supplied to the steering motors 44R, 44L are calculated. The manipulated variables are determined so as to eliminate the error between the desired values θdr, θdl and the detected values θr, θl of the steering angles. Then, in S24, the operation of the steering motors 44R, 44L is controlled based on the calculated manipulated variables, thereby independently steering the outboard motors 12R, 12L.

When the result in S16 is YES (when it is found that the boat 10 is rapidly decelerating), the program goes to S26, in which the desired steering angles θdr, θdl are assigned by retrieving the rapid deceleration mapped data.

Figure 14:
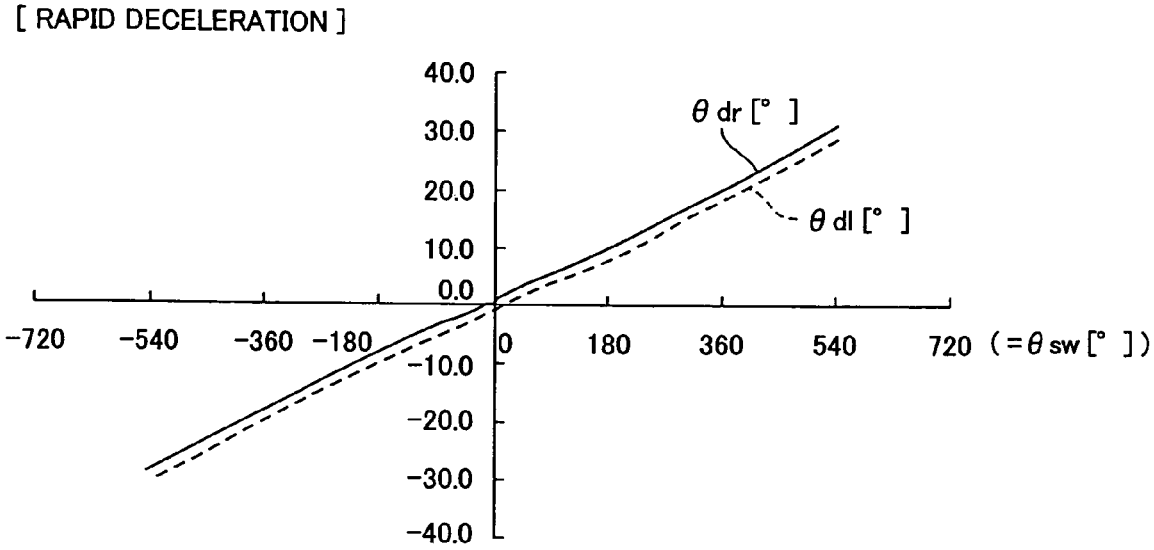
FIG. 14 is a graph representing the characteristics of desired steering angles with respect to rotation angle of the steering wheel shown in FIG. 2 when the engine speed is in rapid deceleration.

FIG. 14 is a graph, similar to that of FIG. 5, but representing the characteristics of the rapid deceleration mapped data and FIG. 15 is a table similar to that of FIG. 6 showing some specific numerical values taken from the characteristics shown in FIG. 14.

As shown in FIGS. 14 and 15, when the steering wheel rotation angle θsw is 0 degree during rapid deceleration, θdr and θdl are made 0.5 degree and −0.5 degree, so that the difference Δθd is made −1 degree.

The setting of θdr to 0.5 degree steers the starboard outboard motor 12R clockwise (in the direction of moving its propeller from right to left as viewed from behind). The setting of θdl to −0.5 degree steers the port outboard motor 12L counterclockwise (in the direction of moving its propeller left to right as viewed from behind). As a result, the extension 16Re of the axis of rotation of the starboard outboard motor propeller and the extension 16Le of the axis of rotation of the port outboard motor propeller are made to intersect rearward of the outboard motors 12R, 12L.

When the absolute value of the steering wheel rotation angle θsw is greater than 0 degree, the desired steering angle of the outboard motor on the opposite side from the turning direction of the boat 10 (the outside outboard motor) is made larger (in absolute value). As a result, the extension 16Re of the axis of rotation of the starboard outboard motor propeller and the extension 16Le of the axis of rotation of the port outboard motor propeller are made to intersect rearward of the outboard motors 12R, 12L.

Thus the desired steering angles θdr, θdl are set to constantly maintain toe-out during rapid deceleration irrespective of the rotation angle θsw. In addition, the absolute value of the difference Δθd (toe-out angle) is set to a larger value than that during acceleration or constant-speed cruising. Good straight course-holding performance and turning performance are therefore maintained even during rapid deceleration. The outboard motors are made to toe-out when the boat 10 is moving straight forward during rapid deceleration because the directions of the forces acting on the boat are opposite from those acting on it during acceleration or constant-speed cruising. The reason for increasing the absolute value of the difference Δθd with increasing rotation angle θsw is the same as that during acceleration or constant-speed cruising.

In the flowchart of FIG. 4, when the result in S12 is NO (when the shift position is reverse or neutral), the program goes to S28, in which the desired steering angles θdr, θdl are assigned by retrieving the reverse mapped data.

Figure 16:
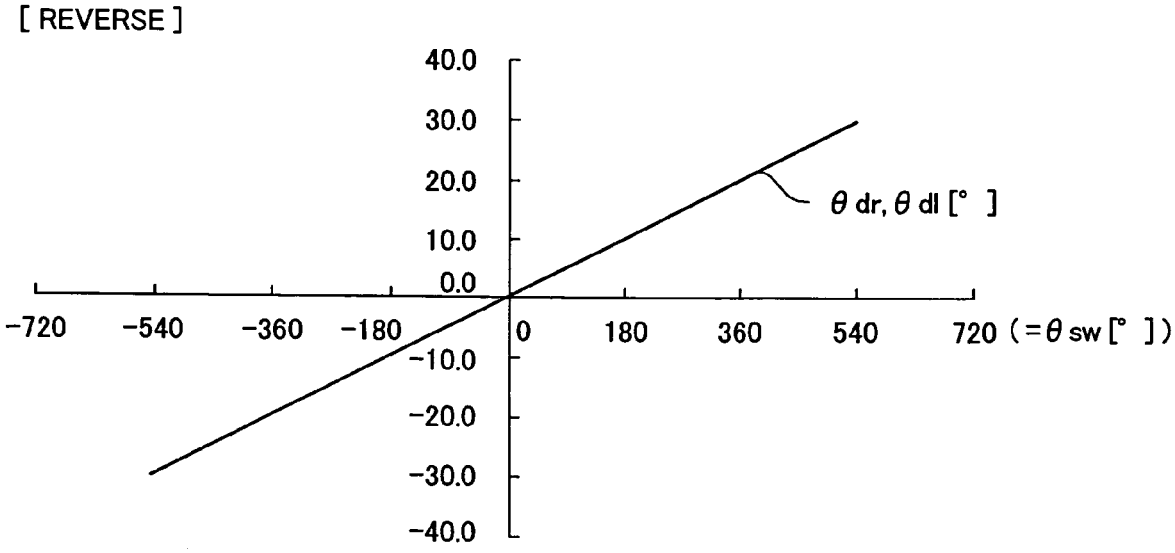
FIG. 16 is a graph representing the characteristics of desired steering angles with respect to rotation angle of the steering wheel shown in FIG. 2 when the engine is moving in reverse.

FIG. 16 is a graph, similar to that of FIG. 5, but representing the characteristics of the reverse mapped data and FIG. 17 is a table similar to that of FIG. 6 showing some specific numerical values taken from the characteristics shown in FIG. 16.

As shown in FIGS. 16 and 17, the reverse mapped data are the same as the mapped data shown in FIG. 5 (the acceleration/constant speed mapped data to be used when the engine speed NEr is 650 rpm). In other words, when the boat is moving in reverse, the difference Δθd is made 0 degree irrespective of the steering wheel rotation angle θsw, so that the extension 16Re of the axis of rotation of the propeller of the starboard outboard motor and the extension 16Le of the axis of rotation of the propeller of the port outboard motor are constantly maintained parallel. That is, neither toe-in nor toe-out is implemented because the speed of the boat when moving in reverse is usually very slow.

As explained in the foregoing, the outboard motor steering control system according to the invention is configured to detect the engine speed NEr and steering wheel rotation angle θsw, individually set or determine the desired steering angles θdr, θdl of the starboard outboard motor 12R and port outboard motor 12L based on the detected values, and independently steer the outboard motors 12R, 12L by controlling the operation of the steering motors 44R, 44L based on the set desired steering angles θdr, θdl. The relative angle between the outboard motors can therefore be regulated in response to the cruising conditions, namely, the relative angle can be set to put the outboard motors in a toe-in, toe-out or parallel relationship, thereby improving both straight course-holding performance and turning performance.

Specifically, the outboard motor steering control system is configured to increase the difference between the desired steering angles θdr and θdl (the absolute value of the difference Δθd) with increasing engine speed NEr. The straight course-holding performance and turning performance can therefore be improved at high engine speed, i.e., during high-speed cruising.

In addition, the outboard motor steering control system is configured to regulate the difference Δθd based on the rotation angle θsw of the steering wheel. The relative angle between the outboard motors can therefore be optimized in accordance with the degree of turning, thereby still more effectively improving straight course-holding performance and turning performance.

Further, the outboard motor steering control system is configured to make the difference Δθd different between the forward and reverse shift (gear) positions. The relative angle between the outboard motors can therefore be optimized for the direction of boat travel, thereby still more effectively improving straight course-holding performance and turning performance.

Moreover, the outboard motor steering control system is configured to regulate the difference Δθd based on change in the cruising speed of the boat 10 (more exactly, change in the engine speed NEr). The relative angle between the outboard motors can therefore be optimized for the boat speed, thereby still more effectively improving straight course-holding performance and turning performance.

As stated above, the present exemplary embodiment is configured to have a system for controlling steering of a plurality of outboard motors (12R, 12L) each mounted on a stern of a boat (10) by a shaft (38R, 38L) to be movable by an actuator (electric steering motor 44R, 44L) relative to the boat and each having an internal combustion engine (50R, 50L) and a propeller (16R, 16L) powered by the engine to propel the boat, comprising: a crank angle sensor (116R, 116L) detecting a speed of at least one of the engines (NEr, NEl) installed in the outboard motors; a rotation angle sensor (112) detecting a rotation angle of a steering wheel (24) installed at a cockpit of the boat; a desired steering angle determining mechanism (ECU 120, S18, S26, S28) for determining a desired steering angle of each outboard motor (θdr, θdl) individually based on at least one of the detected engine speed and the detected rotation angle of the steering wheel; and a controller (ECU 120, S20 to S24) for controlling operation of the actuator based on the determined desired steering angle.

In the system according to the present exemplary embodiment, the desired steering angle determining mechanism determines the desired steering angle of each outboard motor individually such that a difference (Δθd) between the desired steering angles increases with increasing engine speed (S18).

In the system according to the present exemplary embodiment, the desired steering angle determining mechanism determines the desired steering angle of each outboard motor individually such that a difference (Δθd) between the desired steering angles is regulated based on the rotation angle of the steering wheel (S18, S26).

In the system according to the present exemplary embodiment, the desired steering angle determiner determines the desired steering angle determining mechanism determines the desired steering angle of each outboard motor individually such that a difference (Δθd) between the desired steering angles is regulated based on the rotation angle of the steering wheel and the engine speed (S18, S26).

The system of the present exemplary embodiment further includes: a shift position determining mechanism (ECU 120, S12) for determining whether a shift position is forward or reverse; and that the desired steering angle determining mechanism determines the desired steering angle of each outboard motor individually such that a difference between the desired steering angles is made different between the forward and reverse shift positions (S18, S28).

In the system according to the present exemplary embodiment, the desired steering angle determining mechanism determines the desired steering angle of each outboard motor individually such that a difference between the desired steering angles is regulated based on change in a cruising speed of the boat (S16, S18, S26).

In the system according to the present exemplary embodiment, the desired steering angle determining mechanism determines the desired steering angle of each outboard motor individually such that extensions (16Re, 16Le) of axes of rotation of the propellers of the outboard motors are made to intersect forward of the outboard motors, when the engine speed is at a high speed (e.g. 4000 rpm) (S18).

In the system according to the present exemplary embodiment, the desired steering angle determining mechanism determines the desired steering angle of each outboard motor individually such that the extensions of axes of rotation of the propellers of the outboard motors are made to intersect rearward of the outboard motors, when the rotation angle of the steering wheel reaches a predetermined limit (e.g. 180 degrees)(S18).

In the system according to the present exemplary embodiment, the desired steering angle determining mechanism determines the desired steering angle of each outboard motor individually such that extensions of axes of rotation of the propellers of the outboard motors are made to intersect rearward of the outboard motors, when the boat decelerates rapidly (S16, S26).

In the system according to the present exemplary embodiment, the desired steering angle determining mechanism determines the desired steering angle of each outboard motor individually such that extensions of axes of rotation of the propellers of the outboard motors are made parallel irrespective of the rotation angle of the steering wheel, when the engine speed is at a low speed (S18).

In the system according to the present exemplary embodiment, the desired steering angle determining mechanism determines the desired steering angle of each outboard motor individually such that extensions of axes of rotation of the propellers of the outboard motors are made parallel, when the boat moves in reverse (S28).

It should be noted in the above that, although the foregoing explanation is made with regard the case where two outboard motors are mounted on the boat 10, the number of motors can instead be three or more.

It should also be noted that, although it is explained that during acceleration or constant-speed cruising the desired steering angles θdr, θdl are set to take into account the engine speed NEr of the starboard outboard motor, they can instead be set to take into account the engine speed NEl of the port outboard motor or the average of NEr and NEl. It will be understood from the flowchart of FIG. 4, that the desired steering angle determining mechanism determines the desired steering angle of each outboard motor individually such that extensions of axes of rotation of the propellers of the outboard motors are adjustable according to the engine speed.

It should further be noted that the values of the desired steering angles θdr, θdl are not limited to those set out in the foregoing but can be appropriately determined in accordance with the size, specifications and the like of the outboard motors and boat.

It should further be noted that, although electric motors were exemplified for use as the steering actuators 44R, 44L, it is possible instead to utilize hydraulic cylinders or any of various other kinds of actuators.

Japanese Patent Application No. 2005-014308 filed on Jan. 21, 2005, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling steering of a plurality of outboard motors each adapted to be mounted on a stern of a boat by a shaft to be movable by an actuator relative to the boat and each having an internal combustion engine and a propeller powered by the engine to propel the boat, comprising:

a crank angle sensor detecting a speed of at least one of the engines installed in the outboard motors;

a rotation angle sensor detecting a rotation angle of a steering wheel installed at a cockpit of the boat;

a desired steering angle determining mechanism determining a desired steering angle of each outboard motor individually based on the detected engine speed and the detected rotation angle of the steering wheel; and a controller controlling operation of the actuator based on the determined desired steering angle;

wherein the desired steering angle determining mechanism determines the desired steering angle of each outboard motor individually such that extensions of axes of rotation of the propellers of the outboard motors are adjustable according to the engine speed.

2. The system according to claim 1, wherein the desired steering angle determining mechanism determines the desired steering angle of each outboard motor individually such that a difference between the desired steering angles increases with increasing engine speed.

3. The system according to claim 1, wherein the desired steering angle determining mechanism determines the desired steering angle of each outboard motor individually such that a difference between the desired steering angles is regulated based on the rotation angle of the steering wheel.

4. The system according to claim 1, wherein the desired steering angle determining mechanism determines the desired steering angle of each outboard motor individually such that a difference between the desired steering angles is regulated based on the rotation angle of the steering wheel and the engine speed.

5. The system according to claim 1, further including:

a shift position determining mechanism determining whether a shift position is forward or reverse; and the desired steering angle determining mechanism determines the desired steering angle of each outboard motor individually such that a difference between the desired steering angles is made different between the forward and reverse shift positions.

6. The system according to claim 1, wherein the desired steering angle determining mechanism determines the desired steering angle of each outboard motor individually such that a difference between the desired steering angles is regulated based on change in a cruising speed of the boat.

7. The system according to claim 1, wherein the desired steering angle determining mechanism determines the desired steering angle of each outboard motor individually such that extensions of axes of rotation of the propellers of the outboard motors are made to intersect forward of the outboard motors, when the engine speed is at a high speed.

8. The system according to claim 7, wherein the desired steering angle determining mechanism determines the desired steering angle of each outboard motor individually such that the extensions of axes of rotation of the propellers of the outboard motors are made to intersect rearward of the outboard motors, when the rotation angle of the steering wheel reaches a predetermined limit.

9. The system according to claim 1, wherein the desired steering angle determining mechanism determines the desired steering angle of each outboard motor individually such that extensions of axes of rotation of the propellers of the outboard motors are made to intersect rearward of the outboard motors, when the boat decelerates rapidly.

10. The system according to claim 1, wherein the desired steering angle determining mechanism determines the desired steering angle of each outboard motor individually such that extensions of axes of rotation of the propellers of the outboard motors are made parallel irrespective of the rotation angle of the steering wheel, when the engine speed is at a low speed.

11. The system according to claim 1, wherein the desired steering angle determining mechanism determines the desired steering angle of each outboard motor individually such that extensions of axes of rotation of the propellers of the outboard motors are made parallel, when the boat moves in reverse.

12. A method of controlling steering of a plurality of outboard motors each adapted to be mounted on a stem of a boat by a shaft to be movable by an actuator relative to the boat and each having an internal combustion engine and a propeller powered by the engine to propel the boat, comprising the steps of:

detecting a speed of at least one of the engines installed in the outboard motors;

detecting a rotation angle of a steering wheel installed at a cockpit of the boat;

determining a desired steering angle of each outboard motor individually based on the detected engine speed and the detected rotation angle of the steering wheel; and controlling operation of the actuator based on the determined desired steering angle;

wherein the step of the determining the desired steering angle involves determining the desired steering angle of each outboard motor individually such that extensions of axes of rotation of the propellers of the outboard motors are adjustable according to the engine speed.

13. The method according to claim 12, wherein the step of determining a desired steering angle involves determining the desired steering angle of each outboard motor individually such that a difference between the desired steering angles increases with increasing engine speed.

14. The method according to claim 12, wherein the step of determining a desired steering angle also determines the desired steering angle of each outboard motor individually such that a difference between the desired steering angles is regulated based on the rotation angle of the steering wheel.

15. The method according to claim 12, wherein the step of determining a desired steering angle also determines the desired steering angle of each outboard motor individually such that a difference between the desired steering angles is regulated based on the rotation angle of the steering wheel and the engine speed.

16. The method according to claim 12, further including the step of:

determining whether a shift position is forward or reverse;

and wherein the step of determining a desired steering angle also determines the desired steering angle of each outboard motor individually such that a difference between the desired steering angles is made different between the forward and reverse shift positions.

17. The method according to claim 12, wherein the step of determining a desired steering angle also determines the desired steering angle of each outboard motor individually such that a difference between the desired steering angles is regulated based on change in a cruising speed of the boat.

18. The method according to claim 12, wherein the step of determining a desired steering angle also determines the desired steering angle of each outboard motor individually such that extensions of axes of rotation of the propellers of the outboard motors are made to intersect forward of the outboard motors, when the engine speed is at a high speed.

19. The method according to claim 18, wherein the step of determining a desired steering angle also determines the desired steering angle of each outboard motor individually such that the extensions of axes of rotation of the propellers of the outboard motors are made to intersect rearward of the outboard motors, when the rotation angle of the steering wheel reaches a predetermined limit.

20. The method according to claim 12, wherein the step of determining a desired steering angle also determines the desired steering angle of each outboard motor individually such that extensions of axes of rotation of the propellers of the outboard motors are made to intersect rearward of the outboard motors, when the boat decelerates rapidly.

21. The method according to claim 12, wherein the step of determining a desired steering angle also determines the desired steering angle of each outboard motor individually such that extensions of axes of rotation of the propellers of the outboard motors are made parallel irrespective of the rotation angle of the steering wheel, when the engine speed is at a low speed.

22. The method according to claim 12, wherein the step of determining a desired steering angle also determines the desired steering angle of each outboard motor individually such that extensions of axes of rotation of the propellers of the outboard motors are made parallel, when the boat moves in reverse.

* * * * *

UNITED STATES PATENT AND TRADEMARK OFFICE

CERTIFICATE OF CORRECTION

PATENT NO. : 7,325,505 B2
APPLICATION NO. : 11/335149
DATED : February 5, 2008
INVENTOR(S) : Otobe et al.

It is certified that error appears in the above-identified patent and that said Letters Patent is hereby corrected as shown below:

Under What is Claimed is, Column 13, claim 12, line 2:
Change "stem" to --stern--.

Signed and Sealed this

Twenty-seventh Day of May, 2008

JON W. DUDAS
*Director of the United States Patent and Trademark Office*